US006029921A

United States Patent [19]

Johnson

[11] Patent Number: 6,029,921

[45] Date of Patent: Feb. 29, 2000

[54] CENTERPULL PAPER PRODUCT

[76] Inventor: John R. Johnson, 26653 Cotton Bayou Dr., Orange Beach, Ala. 36561

[21] Appl. No.: 09/182,286

[22] Filed: Oct. 29, 1998

[51] Int. Cl.[7] ..... B65H 18/28

[52] U.S. Cl. ..... 242/160.1; 242/160.4; 428/42

[58] Field of Search ..... 242/160.1, 160.4; 493/363, 364, 365; 428/43

[56] References Cited

U.S. PATENT DOCUMENTS

| | | | |
|---|---|---|---|
| 386,618 | 7/1888 | Wheeler | 428/43 |
| 405,412 | 6/1889 | Hicks | 428/43 |
| 453,003 | 5/1891 | Hicks | 428/43 |
| 459,516 | 9/1891 | Wheeler | 428/43 |
| 598,315 | 2/1898 | Cummings | 281/15.1 |
| 607,498 | 7/1898 | Wheeler | 428/43 |
| 5,041,317 | 8/1991 | Greyvenstein | 428/35.5 |
| 5,492,746 | 2/1996 | Chang | 428/78 |
| 5,556,826 | 9/1996 | Perrington et al. | 503/200 |
| 5,562,964 | 10/1996 | Jones | 428/43 |
| 5,704,566 | 1/1998 | Schutz et al. | 242/595 |

FOREIGN PATENT DOCUMENTS

| | | | |
|---|---|---|---|
| 2706234 | 8/1978 | Germany | 428/43 |

*Primary Examiner*—Donald P. Walsh
*Assistant Examiner*—Minh-Chau Pham
*Attorney, Agent, or Firm*—James L. Jackson; Mayor, Day, Caldwell & Keeton L.L.P.

[57] ABSTRACT

A facial quality paper usable with a center feed roll dispenser. The paper has a plurality of perforations for permitting detachment of paper sections from the loose paper end of the roll. A linear density of six perforations or less per inch are formed along the detachment line to facilitate detachment of each paper section without permitting premature detachment of the paper section within the center feed roll dispenser. Alternatively, control over the separation strength is provided by one or more perforations comprising less than seventy percent of the base line. Separation control is provided by the number or perforations per linear inch, by the total ratio of perforations versus paper along the detachment base line, or by the perforation shape 1.

11 Claims, 1 Drawing Sheet

CENTERPULL PAPER PRODUCT

BACKGROUND OF THE INVENTION

The present invention relates to the field of dispensable paper products. More particularly, the invention relates to an improved paper product uniquely suitable for use with a center pull or center feed dispenser.

Paper products are typically dispensed from a roll which rotates as a free paper end is pulled. Each roll comprises a plurality of individual sheets created by perforations at selected intervals. For toilet paper and for paper towels, the number of perforations typically exceeds eight perforations per inch. The density of perforations is important because such density affects the separation performance of the individual paper sheets. Separation strength is also controlled by the paper composition, thickness, and number of paper plys or layers. "Commercial" grade paper is stronger than paper known as "facial" grade and is used for publicly accessible paper requirements.

The type of paper dispenser is preferably matched to the dispensed paper. Although facial grade paper is preferred by many consumers because such paper is soft and comfortable to the touch, facial grade paper cannot be dispensed by many styles of dispensers. Facial grade paper is not sufficiently strong to cooperate with conventional paper dispensers for many reasons. For large rolls which initially contact the dispenser surfaces, drag induced by such contact prevents rolling movement of the paper roll. Additionally, the roll mass provides an inertial force which must be overcome by the facial paper strength as the free end is pulled, and facial paper often separates on such contact. Because facial paper is inherently weak, the slightest amount of moisture, as is commonly found in bath and kitchen facilities, reduces the facial paper strength so that the paper end cannot be dispensed from a paper roll. For all of these reasons, facial paper is not suitable for certain paper requirements.

To overcome the difficulties associated with facial grade paper, commercial grade paper is typically installed in most paper dispensers. Commercial grade paper is particularly used in public facilities, in uses having large dispensers, and in other high traffic areas. Commercial grade paper is stronger than facial grade paper and resists premature separation of the free end.

Centerpull dispensers have been developed to dispense various paper products. For example, U.S. Pat. No. 5,582,362 (1996) discloses a Centerpull™ toilet paper dispenser having a case which restricts collapse of a coreless paper roll. By distributing the paper from the center of the dispenser, movement of the roll is not required.

Paper dispensers have been specifically designed specifically to facilitate separation of individual paper sheets. U.S. Pat. No. 5,370,338 to Lewis (1994) disclosed a center fed dispenser having a device for varying the diameter of a dispensing orifice to accommodate rolled paper products having different weights, widths, bulks and tensile strengths. U.S. Pat. No. 5,205,455 to Moody (1993) disclosed a dispenser having a top and a support having a dispensing aperture. U.S. Pat. Nos. 5,346,064 to Rizzuto (1994) and 5,310,083 to Rizzuto (1994) disclosed a dispenser having a dispenser nozzle, and U.S. Pat. No. 5,246,137 to Schutz et al. (1993) disclosed inserts positioned within a dispenser nozzle to adjust the size and configuration of the dispenser nozzle. U.S. Pat. No. 5,065,924 to Granger (1991) disclosed a cutting device for separating paper into segments, U.S. Pat. No. 4,524,895 to Lunden (1985) disclosed a tearing device having projections for tearing paper, and U.S. Pat. No. 3,627,216 to Ekuan (1971) disclosed an inverted funnel having an opening for dispensing paper from a coreless paper roll.

The problem of dispensing paper products is particularly acute when the paper comprises a moist tissue. U.S. Pat. No. 4,219,129 to Sedgwick (1980) disclosed a moist tissue dispenser having a web of absorbant sheet material divided by transverse perforation lines. A frusto-conical central orifice functioned as a converging passage which imposed a drag on the roped end tissue. Other premoistened towel dispensers were disclosed in U.S. Pat. No. 3,973,695 to Ames (1976), wherein a circular portion of an outlet created a tension for separating the leading tissue perforation, and in U.S. Pat. No. 3,843,017 to Harrison (1974), wherein an interior flap over an opening facilitated separation of individual paper sheets.

Although various dispensers have been designed to facilitate the task of dispensing paper, and the strength of paper has been modified to accommodate different paper requirements, a need exists for an approach which permits softer, facial grade paper to be dispensed from different forms of paper dispensers.

SUMMARY OF THE INVENTION

The present invention discloses a paper product for use with a centerfeed dispenser. The product comprises a paper base comprising facial grade paper, wherein the paper base is initially configured in a roll positionable in the centerfeed dispenser and the paper base has a free end extending from the center of the roll. A plurality of perforations form at least one detachment base line in the paper base for permitting selective detachment of a paper base section from the free end, and the perforations have a linear density equal to six perforations or less per inch along the base line.

In other embodiments of the invention, the perforations comprise less than seventy percent of the base line, and the density of the perforations can be accomplished with different shapes and perforation configurations. The invention is suitable for use with single ply or multi-ply paper.

DESCRIPTION OF THE PREFERRED EMBODIMENTS

The invention provides an improved paper product particularly suitable for use with center pull or center feed paper dispensers. The invention controls the separation strength of the paper by selecting the number of perforations, the density of perforations, or the configuration of configurations.

Figure 1:
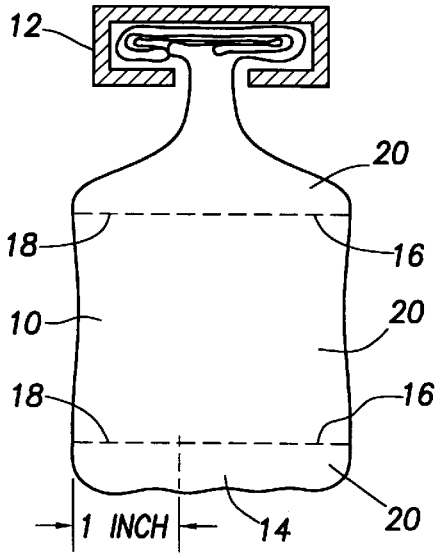
FIG. 1 illustrates a paper product having six or less perforations per inch.

FIG. 1 illustrates one embodiment of the invention wherein paper base 10 is shown. Base 10 is configured within roll 12 and has free end 14. Perforations 16 in base 10 extend along base line 18. Each group of perforations 16 along each base line 18 define a paper base section 20 which is separable from roll 12. Perforations 16 provide a controlled separation line identified as base line 18 which permits the controlled separation of each paper base section 20 from roll 12. When free end 14 is pulled by a user, perforations 16 facilitate the parting of the end base section 20 from roll 12. Facial paper is not used in certain dispensers and in certain applications because the strength of facial paper is not sufficiently strong to resist tearing of such facial paper in the middle of a paper base section 20.

Figure 2:
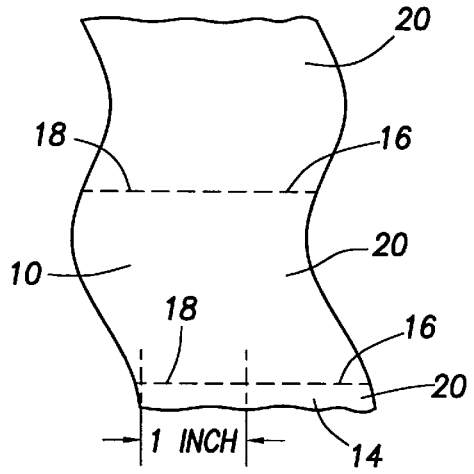
FIG. 2 illustrates a paper product having four perforations per inch.

The invention overcomes this limitation of facial paper by providing six or less perforations 16 per inch (along base line 18) in facial paper for use in a center pull or a center feed dispenser. FIG. 2 illustrates another embodiment of the invention wherein four perforations 16 per inch along base line 18 are incorporated. Four perforations 16 per inch are more desirable than six if paper base 10 has reduced tensile strength.

Figure 3:
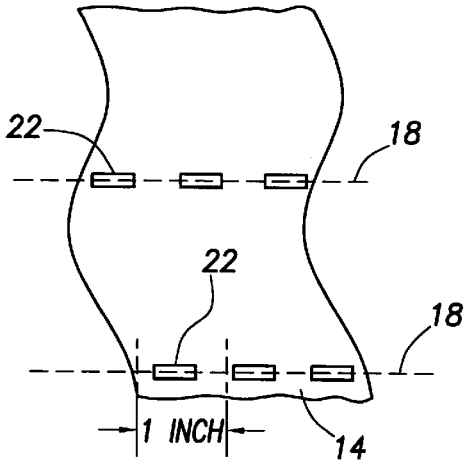
FIG. 3 illustrates a paper product having one perforation comprising less than seventy percent of a base line.

Separation control over base section 20 can also be maintained by having a single perforation which provides a selected amount of perforation space per unit length over base line 18. As shown in FIG. 3, perforations 22 can be positioned along base line 18 at a frequency of one per inch. Perforations 22 also comprise less than seventy percent of the total base line 18 length. This percentage of perforated volume is sufficient to provide adequate separation qualities while providing sufficient strength to resist premature separation of free paper end 14 from roll 12.

Figure 4:
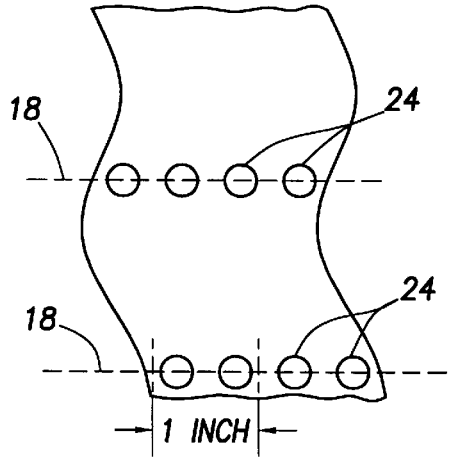
FIG. 4 illustrates a paper product having two shaped perforations per inch.
Figure 5:
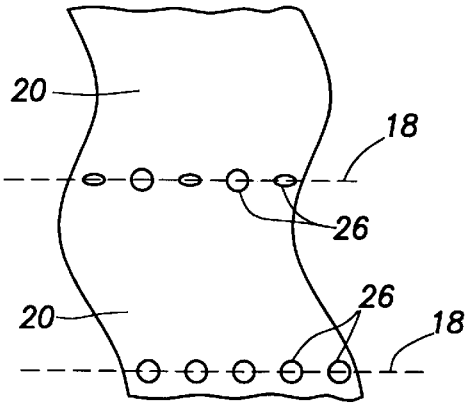
FIG. 5 illustrates shaped perforations.

FIG. 4 illustrates another embodiment of the invention wherein two perforations 24 per inch are positioned along base line 18. Perforations 24 are circular to provide uniform tear resistance around the entire circumference of each perforation 24. Alternatively, the perforations can be shaped to facilitate separation along base line 18. As shown in FIG. 5, perforations 26 are configured to provide the selected percentage distribution less than seventy percent along base line 18, but also to facilitate separation of base section 20 along base line 18. This is accomplished by using the principal of notch sensitivity in the separation process, and differs from the circular perforations illustrated in FIG. 4.

The invention is useful with different dispensers other than center pull or center feed dispensers, and is useful with different grades and qualities of facial paper. As described herein, the shape, number, configuration, and density of perforations along a base line can be selected to balance parameters regarding tensile strength, paper softness, and separation capabilities. The invention can also be used with single ply or multiple layered paper having different tensile properties.

Although the invention has been described in terms of certain preferred embodiments, it will become apparent to those of ordinary skill in the art that modifications and improvements can be made to the inventive concepts herein without departing from the scope of the invention. The embodiments shown herein are merely illustrative of the inventive concepts and should not be interpreted as limiting the scope of the invention.

What is claimed is:

1. A paper product for use with a centerfeed dispenser, comprising:

a paper base comprising facial grade paper, wherein said paper base is initially configured in a roll defining axial ends and being positionable in the centerfeed dispenser, and wherein said paper base has a free end extending laterally from the center of said roll in a direction substantially aligned with the center of the roll;

a plurality of perforations forming at least one detachment base line in said paper base for permitting selective detachment of a paper base section from said free end, and wherein said perforations have a linear density equal to six perforations or less per inch along said base line and comprise less than seventy percent of total base line length.

2. A paper product as recited in claim 1, wherein said perforations have a linear density equal to four perforations or less per inch along said base line.

3. A paper product as recited in claim 1, wherein said perforations have a linear density of one perforation per inch along said base line.

4. A paper product as recited in claim 1, wherein said base comprises two-ply paper.

5. A paper product as recited in claim 1, wherein said base comprises one-ply paper.

6. A paper product as recited in claim 1, wherein each of said perforations are of circular configuration.

7. A paper product for use with a centerfeed dispenser, comprising:

a paper base comprising facial grade paper, wherein said paper base is initially configured in a core-less roll defining a center and being positionable in the centerfeed dispenser, and wherein said paper base has a free end extending from the center of said roll in a direction substantially aligned with said center of said roll;

perforations in said paper base for permitting selective detachment along a base line of a paper base section from said free end, wherein said perforations having a linear density of six perforations or less per inch and comprising less than seventy percent of said base line.

8. A paper product as recited in claim 7, wherein said perforations comprise less than forty percent of said base line.

9. A paper product as recited in claim 7, further comprising less than six perforations per inch.

10. A paper product as recited in claim 7, further comprising less than four perforations per inch.

11. A paper product as recited in claim 7, further comprising one perforation per inch.

* * * * *